United States Patent [19]

Williams

[11] 3,940,170

[45] Feb. 24, 1976

[54] HAND PINNER AND KNEE KICKER

[76] Inventor: William H. Williams, Rte. 2, Box 299-W, Monroe, La. 71201

[22] Filed: June 28, 1974

[21] Appl. No.: 484,113

[52] U.S. Cl. ..... 294/8.6; 81/52.35

[51] Int. Cl.[2] ..... A47G 27/04

[58] Field of Search ..... 294/8.6; 29/254, 275; 81/52.3, 52.35; 145/30.5; 173/93.7; 254/57, 60, 61

[56] References Cited

UNITED STATES PATENTS

| | | | |
|---|---|---|---|
| 1,919,840 | 7/1933 | Hoobler | 294/8.6 |
| 2,184,019 | 12/1939 | Owens | 294/8.6 |
| 2,572,370 | 10/1951 | Moeller | 81/52.35 |
| 2,923,335 | 2/1960 | Joyce | 81/52.35 X |
| 3,568,657 | 3/1971 | Gue | 145/30.5 X |
| 3,757,409 | 9/1973 | Flanigan | 29/254 |

*Primary Examiner*—Evon C. Blunk
*Assistant Examiner*—Johnny D. Cherry
*Attorney, Agent, or Firm*—Raymond N. Matson

[57] ABSTRACT

A knee kicker which also incorporates means for intensifying the force of the blow to the carpet engaging head in carpet laying.

1 Claim, 3 Drawing Figures

HAND PINNER AND KNEE KICKER

The present invention relates generally to carpet stretchers which are used during the laying of carpets and more particularly to devices which are very well known in the art as knee kickers.

A knee kicker is provided at one end with prongs to penetrate the edges of the carpet and at the other end with a pad. By bumping the pad with the knee, the carpet is stretched and may be secured in its proper position.

Experience has shown that prolonged use of the human knee as a hammer develops painful bruises and knee trouble and quite often, permanent disability of the knee.

Accordingly, the main object of the present invention is to provide an improved carpet laying device of the knee kicker type which will eliminate the above and other disadvantages of known devices.

An important object of the present invention is to provide an improved carpet layer of the knee kicker type which will enable the user to apply the full force of the blow to the carpet which is not possible on conventional knee kickers due to the cushion on the end of the tool.

Another important object of the present invention is to provide an improved carpet laying tool of the type described which enables the user to pin carpet in tight and hard to get at places which cannot be done effectively with conventional knee kickers.

A further important object of the present invention is to provide an improved carpet laying tool which permits the necessary carpet stretching force to be applied by hand without risking injury thereto, and much faster and more effectively than before.

Other objects and advantages of the present invention will become apparent during the course of the following description.

In the drawings, there is shown one embodiment of the invention. In this showing:

Figure 1:
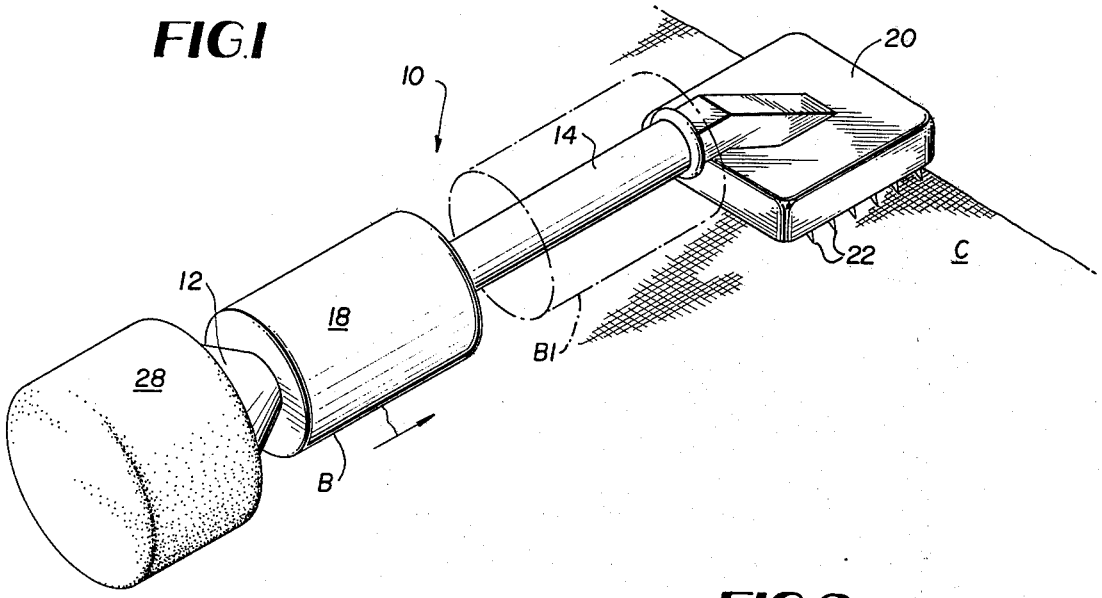
FIG. 1 is a perspective view showing the pronged carpet stretching head engaging the edge of a carpet and the position of the hand weight before and after the hand actuated blow.
Figure 2:
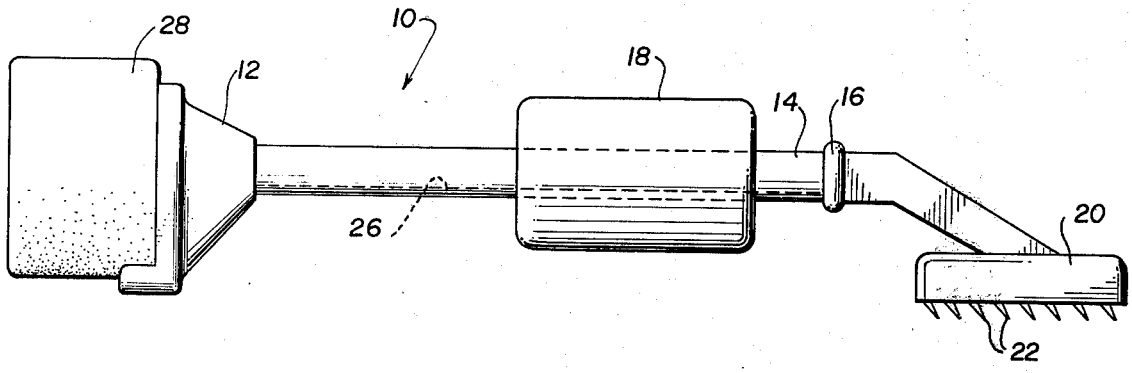
FIG. 2 is a side elevational view thereof.
Figure 3:
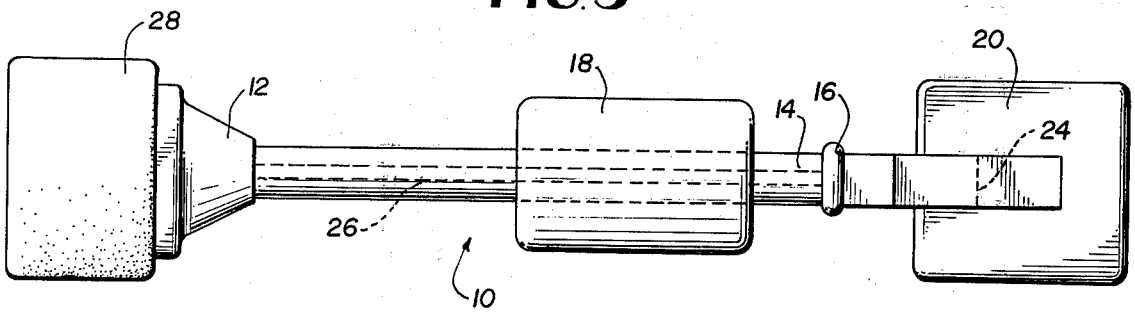
FIG. 3 is a top plan view thereof.

Referring to the drawings, numeral 10 designates the carpet stretching tool as a whole which embodies the present invention and which may also be used as a conventional knee kicker.

The tool thus comprises a head end 12, a shank 14, an integral peripheral shoulder 16 on the shank 14 for engagement by a sliding hand weight 18, and a carpet engaging head 20 having prongs 22. Various carpet engaging heads 20 may be used for differing prong lengths and to this end, the head 20 is indicated as being detachable by dotted lines 24.

By way of example, the size of the shank shaft 14 may be 1 inch in diameter with a ⅜ inch key-way 26 formed in the bottom thereof. The sliding hand weight 18 may weigh 3, 5, or 9 pounds depending upon the size needed or the desire of the carpet layer. It will be apparent that the bottom of the weight 18 must be provided with a key to travel in the key-way 26 to control the angle of the head 20.

As earlier stated, the present invention may also be used as a regular knee kicker and to this end, cushioning material 28 is secured to the head 12. In use, the head 20 engages the carpet C and the sliding hand weight 18 is forcefully moved from position B against the head 12 to the position B1 against the shoulder and stop 16 (FIG. 1) to thus transmit the full force of the blow to the head 20. The stop 16 may take other forms than the peripheral one shown.

It is to be understood that the form of my invention herewith shown and described is to be taken as a preferred example of the same and that various changes in the shape, size and arrangement of parts may be resorted to without departure from the spirit of the invention or the scope of the subjoined claims.

What is claimed is:

1. The combination with a knee kicker having a shank, a carpet-engaging head with depending prongs, and a padded head engageable by the knee to stretch the carpet; of a peripheral shoulder formed on said shank adjacent to said carpet engaging head and defining a stop; and a weight slidably mounted on said shank and forcefully moveable by hand from the padded head to and against said stop to impart a sharp tug to said carpet by said carpet engaging-head.

* * * * *